US006098316A

United States Patent [19]

Hong

[11] Patent Number: 6,098,316

[45] Date of Patent: Aug. 8, 2000

[54] STEP LENGTHENING SHOE

[76] Inventor: Joseph Hong, 13917 205th Ave. NE., Woodinville, Wash. 98072

[21] Appl. No.: 09/404,554

[22] Filed: Sep. 23, 1999

[51] Int. Cl.[7] ..... A43B 3/26

[52] U.S. Cl. ..... 36/97; 36/1; 36/25 R; 36/27

[58] Field of Search ..... 36/25 R, 27, 97, 36/102, 103, 1

[56] References Cited

U.S. PATENT DOCUMENTS

| | | | |
|---|---|---|---|
| 2,112,052 | 3/1938 | Smith | 36/97 |
| 2,413,545 | 12/1946 | Cordi | 36/1 |
| 2,696,683 | 1/1953 | Ciaio | 36/97 |
| 2,810,213 | 5/1956 | Jonas | 36/1 |
| 2,933,832 | 4/1960 | Ayala et al. | 36/1 |
| 4,060,918 | 12/1977 | Mandel | 36/97 |
| 5,029,575 | 7/1991 | Zhivotchenko et al. | 36/97 |

*Primary Examiner*—Paul T. Sewell
*Assistant Examiner*—Troy Arnold
*Attorney, Agent, or Firm*—Delbert J. Bernard

[57] ABSTRACT

A main body portion of a shoe includes a base having a heel and a sole, and an upper on the base. A lower sole is positioned below the base sole and is movable front to rear and back relative to the base sole. A transducer is provided in the seal and is connected to the lower sole. The transducer pushes the lower sole forwardly in response to heel pressure being imposed by the heel of the wearer on the heel of the shoe. After a forward shoe is set down on the ground, with its heel up and its lower sole contacting the ground, the main body portion of the shoe, with the wearer's foot inside of it, slides forward and adds length to the step.

9 Claims, 6 Drawing Sheets

FIG. 16
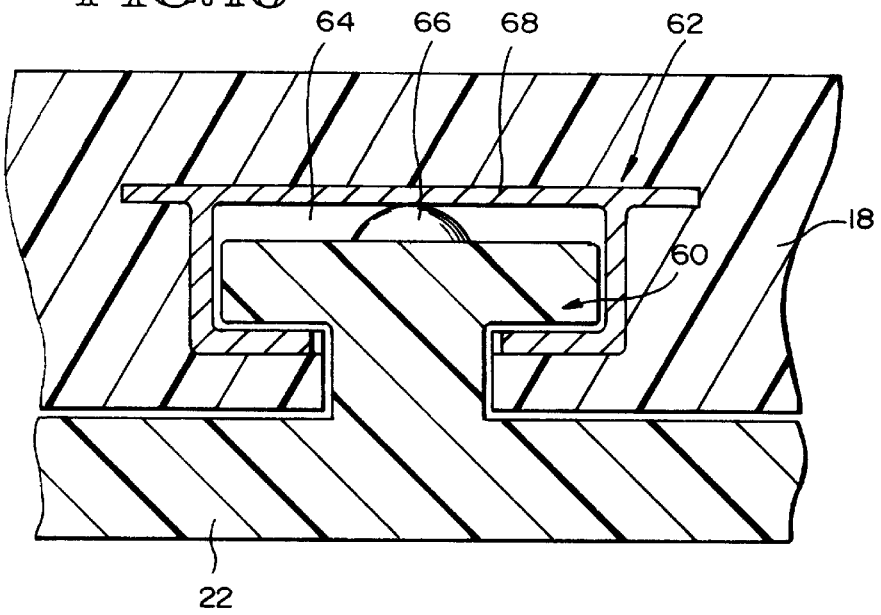
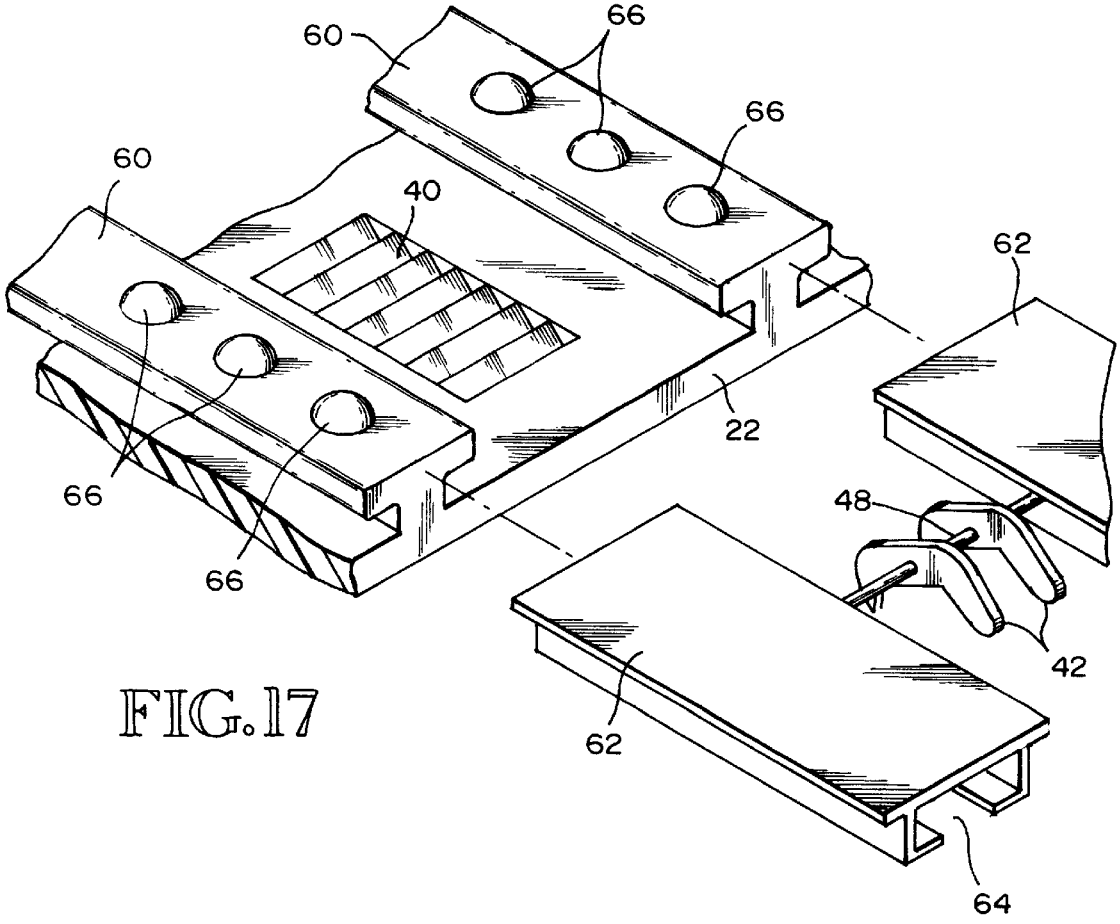
FIG. 17

STEP LENGTHENING SHOE

TECHNICAL FIELD

This invention relates to shoes and, in particular, to shoes having lower sole portions that are movable forwardly relative to the shoe proper, for increasing the length of each step.

BACKGROUND OF THE INVENTION

People walk and run the same way. They pick up one foot while the other foot is still on the ground. The elevated foot is moved forwardly in the air and is then set down. The heel contacts first while the toe is still elevated. After heel contact, the foot is swung downwardly to move the ball of the foot into contact with the ground and raise the heel. At the same time, the person shifts his/her weight on the trailing foot, moving the toe downwardly and raising the heel. Using conventional shoes, with each step the walker or runner moves forwardly a distance equal to the distance between the rear end of the trailing shoe and the front end of the leading shoe.

An object of this invention is to provide a shoe that increases the length of each step by allowing the upper portion of each forward shoe to slide forwardly into an advanced position before the shoe is lifted and moved to create the next step.

An object of the invention is to lengthen each step an amount substantially equal to about ⅜ of an inch to about ¾ of an inch. Over a long distance these additional increments of travel add up to a substantial amount of extra travel by the walker or runner.

BRIEF SUMMARY OF THE INVENTION

Shoes of the present invention are characterized by a main body portion including a base having a heel and a base sole, and an upper on the base. A lower sole is provided below the base sole and is adapted to be movable front to rear and back relative to the base sole. A transducer is positioned within the heel of the shoe and is connected to the lower sole. The transducer functions to push the lower sole forwardly in response to heel pressure being imposed downwardly on it by the heel of the wearer.

In one embodiment, the transducer includes an upwardly bowed leaf spring in the heel of the shoe and connection structure interconnected between the forward end of the leaf spring and the lower sole. Downward heel pressure on the leaf spring will flatten the leaf spring and move it and the connector structure forwardly, to exert a forward pushing force on the lower sole.

In a second embodiment, the transducer includes a fluid chamber in the heel of the shoe having a deformable upper wall. At least one tubular member extends forwardly from the fluid chamber towards the lower sole. The tubular member includes an internal chamber. A piston is connected at its front end to the lower sole. The piston extends rearwardly into the internal chamber of the tubular member. A downward heel force on the upper wall of the fluid chamber will force fluid out from the fluid chamber and into the tubular chamber. Once inside the tubular chamber, the fluid exerts an endwise force on the piston that moves the piston and the lower sole forwardly.

According to an aspect of the invention, ratchet teeth are provided on a portion of the lower sole. A locking lever is incorporated within the base sole. The locking teeth and the locking lever are adapted to permit a forward movement of the lower sole relative to the main body portion of the shoe. They are also adapted to lock the lower sole against rearward movement whenever there is no downward force acting on the locking lever. The locking lever is positioned to be moved from a locking position to an unlocking position by foot pressure acting downwardly onto the locking lever when the lower sole is on a supporting surface and the heel is elevated above the supporting surface.

According to an aspect of the invention, a tension spring may be interconnected between the lower sole and a part of the main body portion of the shoe that is rearwardly of the lower sole portion. The tension spring is arranged to extend when the lower sole is moved forwardly relative to the main body portion of the shoe. It is also arranged to retract and exert a pulling force on the lower sole for pulling the lower sole rearwardly.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWING

Like reference numerals and letters are used to designate like parts throughout the several figures of the drawing, and:

FIG. 16 is a fragmentary sectional view taken substantially along line 16—16 of FIG. 3; and FIG. 17 is a fragmentary pictorial view of a portion of the lower sole and inset structure for the base sole.

DETAILED DESCRIPTION OF THE INVENTION

Figure 1:
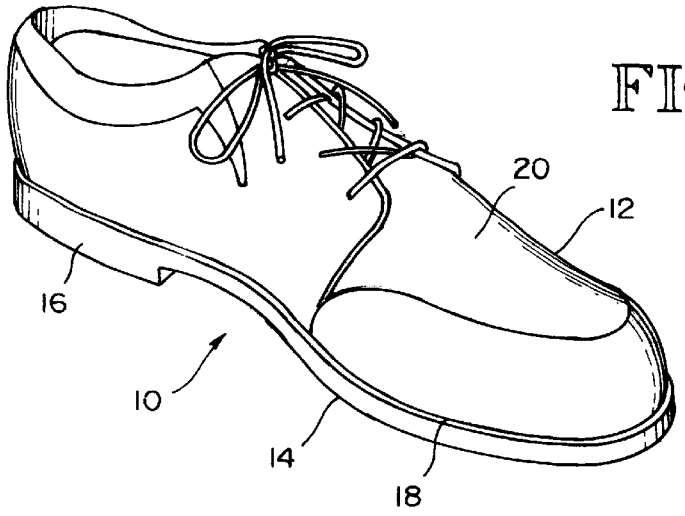
FIG. 1 is a pictorial view of a shoe, taken from above and looking towards the top, one side and the front of the shoe.
Figure 2:
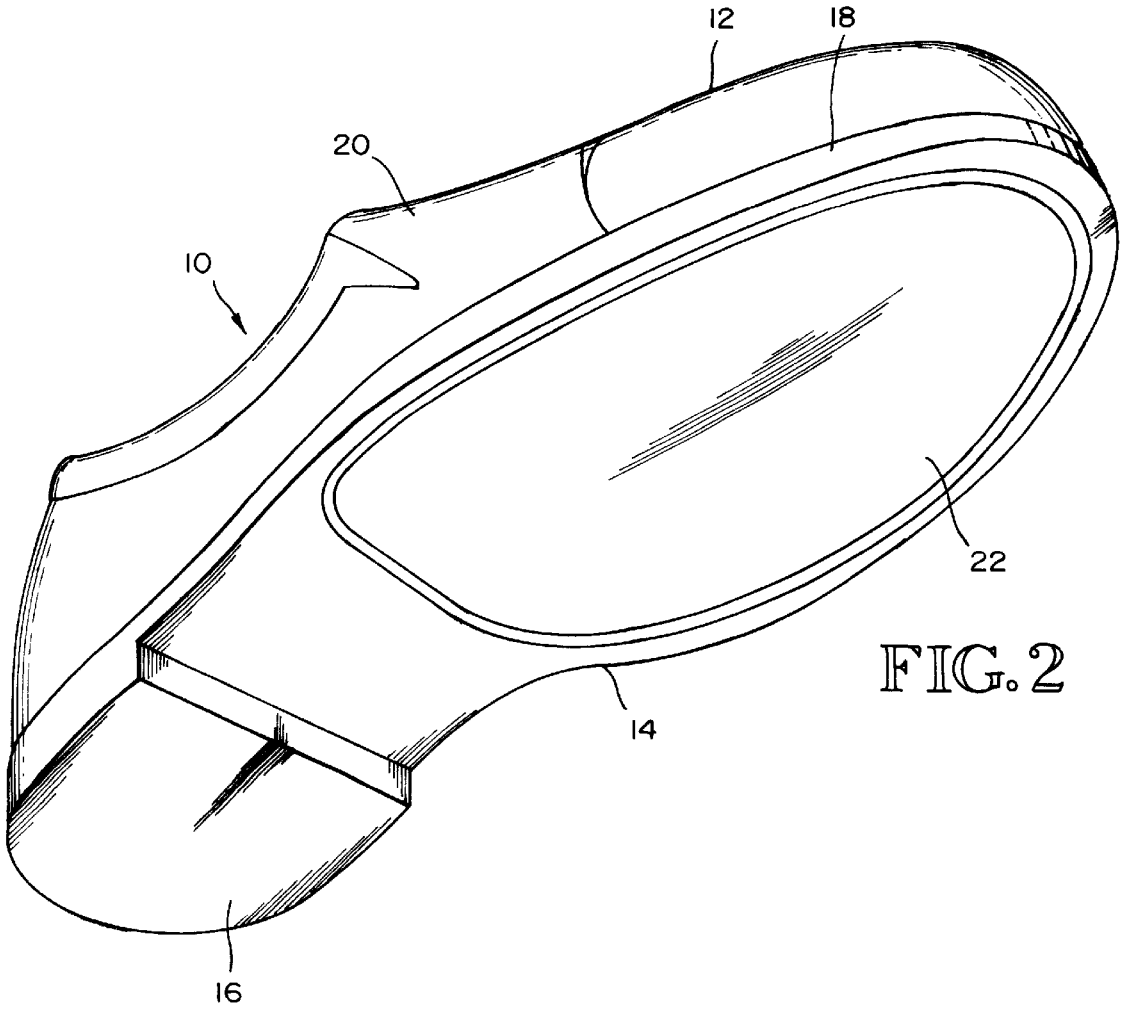
FIG. 2 is an enlarged scale pictorial view of the shoe shown by FIG. 1, taken from below and looking towards the bottom, the right side and the front of the shoe.

FIG. 1 shows a shoe 10 that may be a walking shoe. However, it is to be understood that the present invention applies to both walking shoes and running shoes. Shoe 10 has a main body portion 12 that includes a base 14 having a heel 16 and a base sole 18. Main body portion 12 also includes an upper 20 on the base 14. A lower sole 22 is positioned below the base sole 18.

Figure 3:
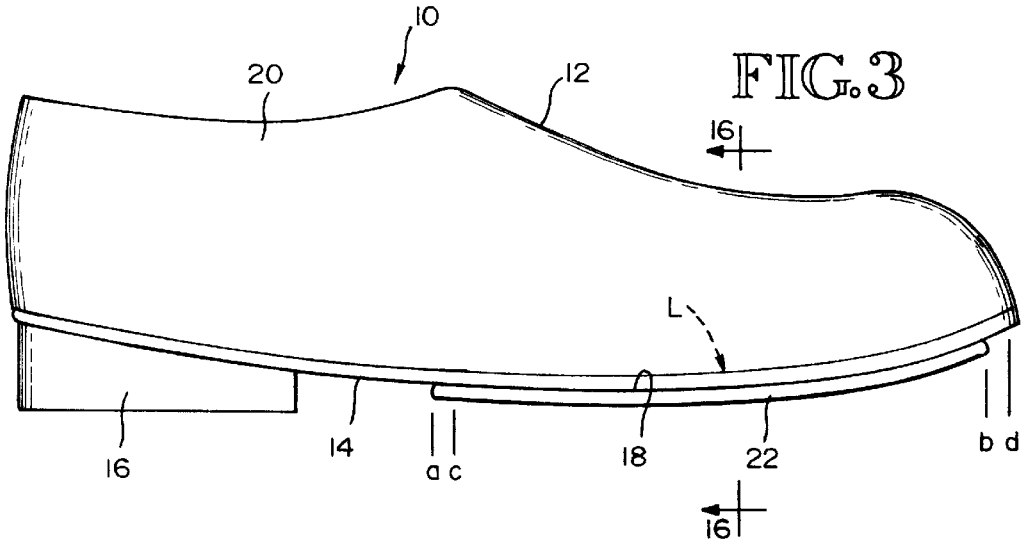
FIG. 3 is a side elevational view of the shoe shown by FIGS. 1 and 2, but with some detail omitted.
Figure 4:
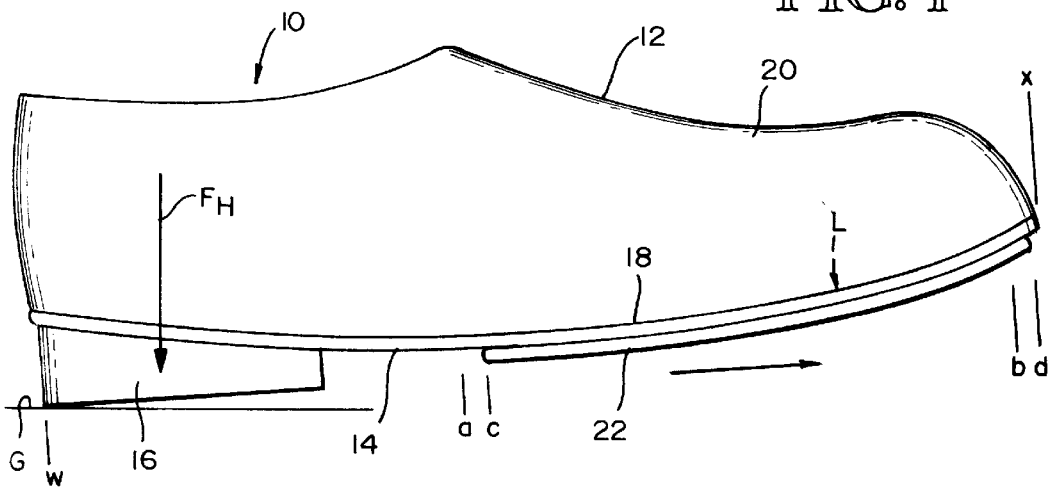
FIG. 4 is a view like FIG. 3, showing the heel down on a surface and the toe raised above the surface, and showing the lower sole in the process of moving forwardly from the position shown in FIG. 3.
Figure 5:
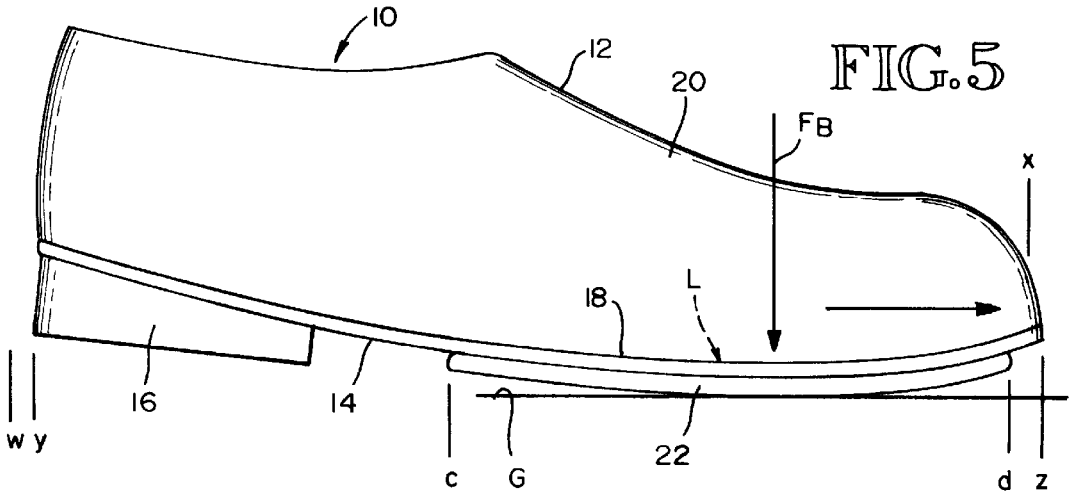
FIG. 5 is a view like FIGS. 3 and 4, but showing the heel raised above the surface and the toe down on the surface, and showing the body of the shoe moving forwardly relative to the lower sole.

As shown by FIGS. 3–13, the lower sole 22 is slidable in position relative to the shoe proper by a distance a–c or b–d. This distance may be about ⅜–¾ of an inch, for example. FIG. 3 shows the rear end of lower sole 22 at position a. The front end of lower sole 22 is at the position b. During walking or running, the lower sole 22 moves forwardly, placing its rear end at location c and its front end at location d. FIG. 4 shows a shoe 10 moving into contact with the ground, a floor, or some other surface G. The heel touches first while the front region of the shoe 10 is elevated. A force $F_h$ is applied by the heel of the wearer of the shoe 10. As will be explained, this force $F_h$ causes the forward movement of the lower sole 22. FIG. 5 shows the same shoe 10 after its wearer has swung the front part of the shoe 10 downwardly to move the lower sole 22 into contact with the surface G followed by a raising of the heel 16 above the surface G. At that time, the ball of the foot applies a force $F_b$ on the base sole 18, above the lower sole 22. As will hereinafter be described in more detail, this force $F_b$ unlocks a lock that is positioned between the shoe proper and the lower sole 22, allowing the shoe proper to slide forwardly on the lower sole 12.

FIG. 4 shows the rear tip of the heel designated W and the front tip of the toe designated X. Without the invention, the step length would be equal to the distance between W and X. FIG. 5 shows the shoe proper moved forwardly on the lower sole 22. This moves location W forwardly to a new location Y. It also moves location X forwardly to a new location Z. Most importantly, it moves the foot of the wearer forwardly a distance equal to W–Y or X–Z.

Figure 6:
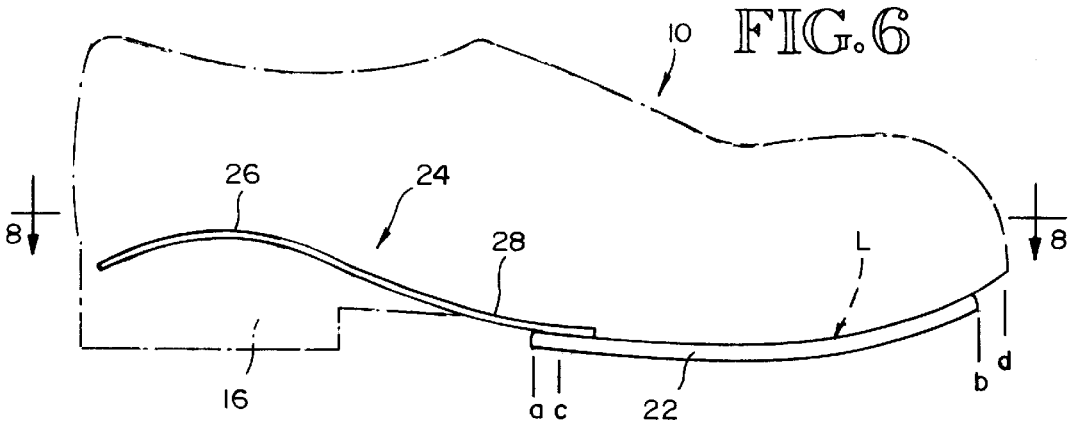
FIG. 6 is a diagrammatic view of the shoe shown by FIGS. 1–5, showing a leaf spring in the heel region of the shoe, the lower sole and an interconnecting structure in solid lines and the remaining outline of the shoe in broken line, and with the spring shown in an unloaded condition.
Figure 7:
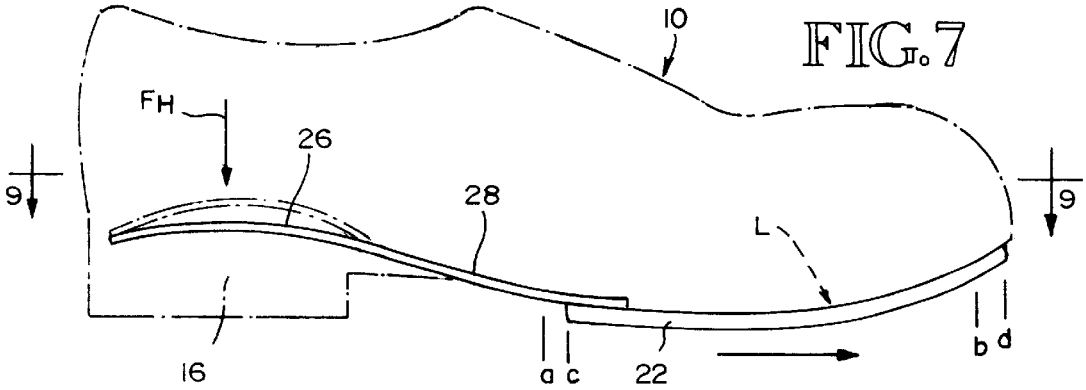
FIG. 7 is a view like FIG. 6, but showing the spring depressed and showing the spring and the connecting structure acting to push the lower sole forwardly relative to the rest of the shoe.
Figure 8:
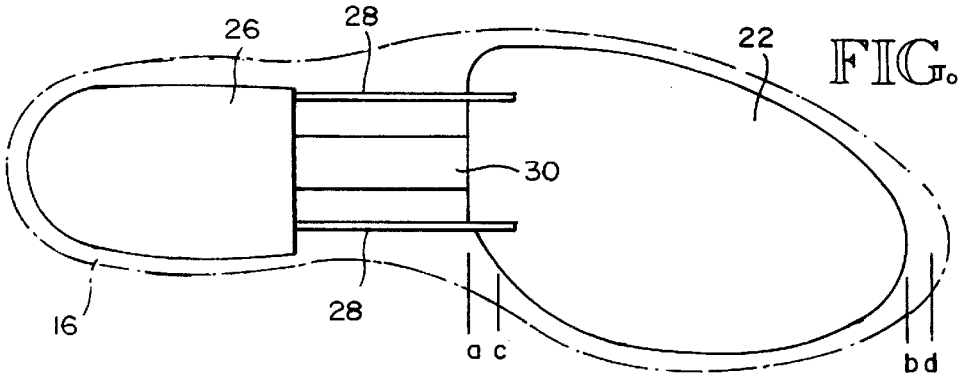
FIG. 8 is a sectional view taken substantially along line 8—8 of FIG. 6.
Figure 9:
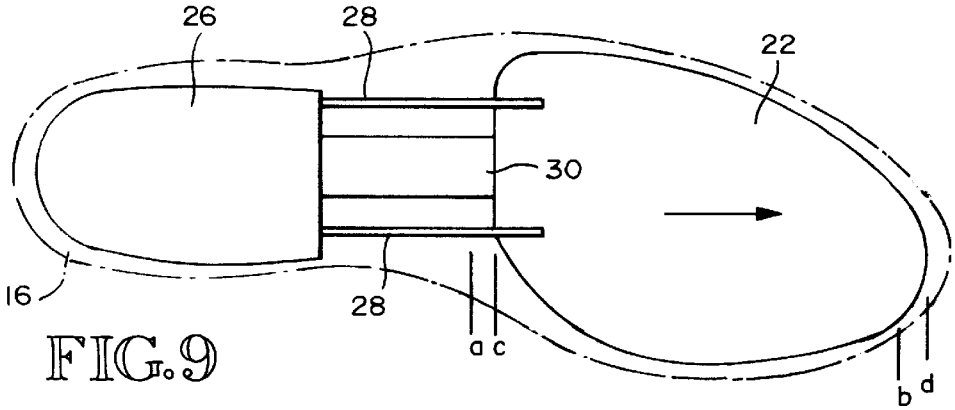
FIG. 9 is a sectional view taken substantially along line 9—9 of FIG. 7.
Figure 10:
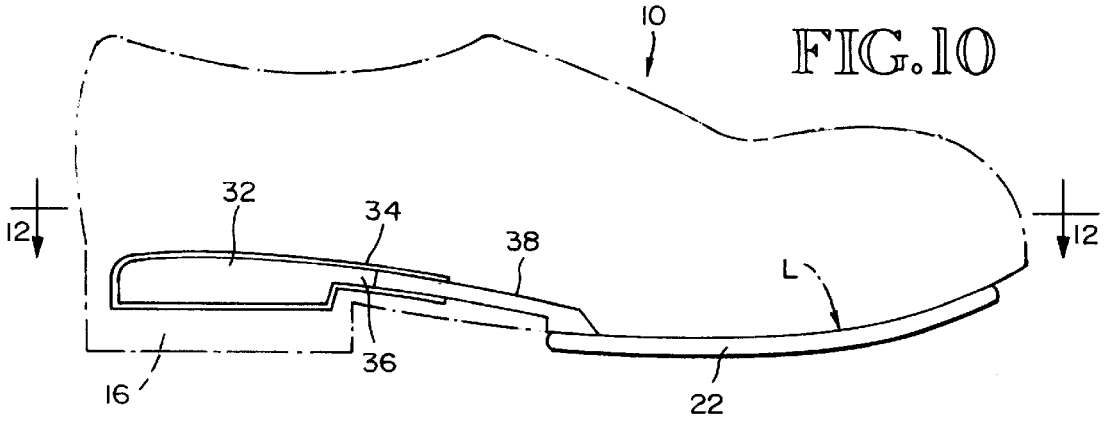
FIG. 10 is a view like FIG. 6 but showing a fluid motor in place of the leaf spring and showing connecting structure in the form of a piston and cylinder, such view showing the fluid motor in an unloaded condition.
Figure 11:
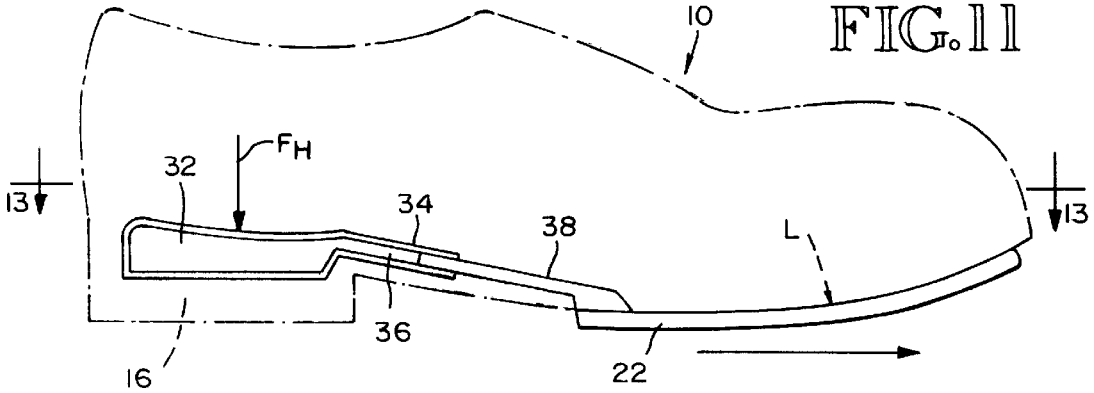
FIG. 11 is a view like FIG. 10, but showing the fluid motor depressed and showing the fluid motor and the connecting structure moving the lower sole forwardly relative to the rest of the shoe.
Figure 12:
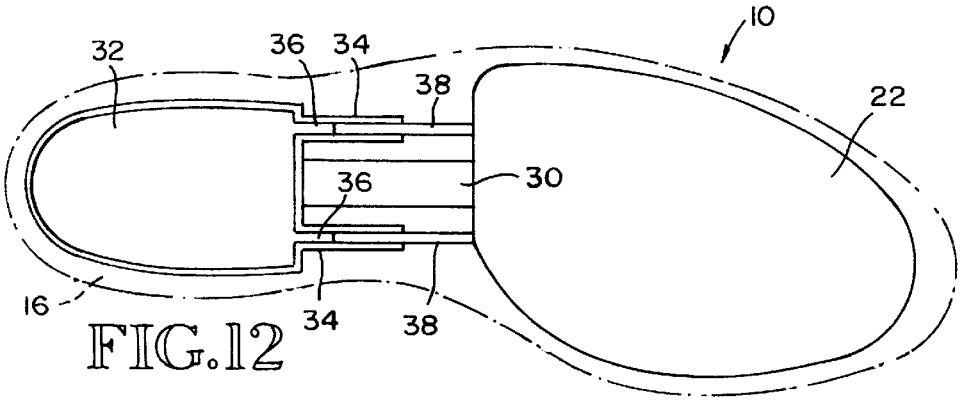
FIG. 12 is a sectional view taken substantially along line 12—12 of FIG. 10.
Figure 13:
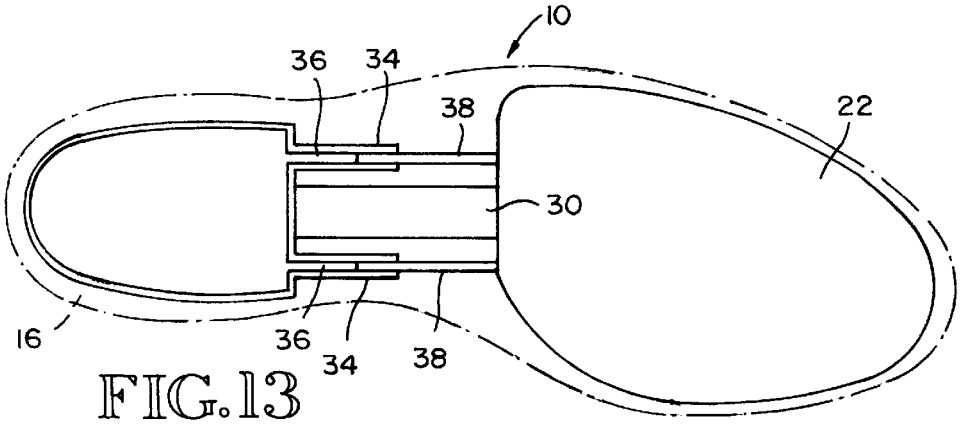
FIG. 13 is a sectional view taken substantially along line 13—13 of FIG. 11.

Referring to FIGS. 6–9, the shoe 10 includes a transducer 24 in the form of an upwardly bowed leaf spring 26 and connecting structure that connects the leaf spring 26 to the lower sole 22. As shown by FIGS. 8 and 9, the connecting structure may be a pair of laterally spaced apart struts 28, 28. The rear ends of the struts 28, 28 are connected to the leaf spring 26. The front ends of the struts 28, 28 are connected to the lower sole 22. When the weight of the wearer's foot is on the ball of the foot, and the heel 16 is raised, there is no downward force imposed on the leaf spring 26 and the leaf spring 26 assumes an upwardly bowed position, as shown in FIG. 6. When the wearer first takes a step, and causes contact between the heel 16 and the ground, while the toe portion of the shoe 10 is elevated, weight is shifted to the heel of the shoe 10 and a downward force $F_h$ is imposed on the leaf spring 26. This force $F_h$ flattens the leaf spring and in so doing moves the forward end of the leaf spring 26 forwardly. This moves the connecting structure 28, 28 and the lower sole 22 forwardly. Initially, the rear end of lower sole 22 is at position a and its front end is at position b. After being shifted forwardly, the rear end is at new position c and the front end is at new position d (FIG. 7). The leaf spring 26 stays flattened as long as the heel force $F_h$ is on it. However, when the wearer shifts his weight to the ball region of his foot and lifts his heel up off of the leaf spring 26, the leaf spring 26 assumes it upwardly bowed shape. While this is happening, the shoe proper moves forwardly on the lower sole 22. Lower sole 22 is on the ground and its position is fixed. As it resumes its upwardly bowed shape, the leaf spring 26 wants to pull the lower sole 22 rearwardly. Instead, the portion of the shoe above lower sole 22 moves forwardly on the lower sole 22.

FIGS. 8 and 9 show a tension spring 30 interconnected between the heel region 16 and the lower sole 22. Preferably, this member 30 is a piece of elastomeric member that always has at least some slight tension in it. When the lower sole 22 moves forwardly relative to the heel 16, the member 30 stretches. This stores energy in it. Once the shoe 10 is moved up off the heel 16, the stored energy in member 30 helps move the shoe proper forwardly relative to lower sole 22.

As is known in the art, shoes in general have one or more layers of inserts inside the shoe, above the base sole. Examples of these inserts are disclosed in U.S. Pat. No. 4,103,440, granted Aug. 1, 1978 to Peter A. Lawrence. The leaf spring 26 and the connector structure 28 may be positioned amongst or between two inserts.

FIGS. 10–13 are like FIGS. 6–9 except that they show a different form of transducer. In these figures, the transducer is a fluid motor. A fluid chamber 32 is incorporated into the heel 16. It serves in place of the leaf spring 26. In the illustrated embodiment, a pair of tubular members 34 extend forwardly from the fluid chamber 32. Each tubular member 34 includes an internal chamber 36. A pair of pistons 38 are connected at their forward ends to the lower sole 22. Pistons 38 extend rearwardly from lower sole 22 into the internal chambers 36. In this embodiment, when a heel force $F_h$ is applied to the fluid chamber 32, fluid is squeezed out of the chamber 32 into the internal chambers 36. When in the internal chambers 36, the fluid acts on the rear ends of the pistons 38, 38, creating a forward force on the pistons 38, 38 and the lower sole 22. This force moves the lower sole 22 forwardly much in the same manner that the leaf spring 26 did when a heel force $F_h$ was implied on it. This embodiment may also include a tension spring 30 for use in returning the lower sole 22 to its original position relative to the rest of the shoe. Also, the fluid chamber 32 may include one or more coil springs extending vertically between its top and bottom walls, to help chamber 32 resume its static shape when the force $F_h$ is removed.

Figure 14:
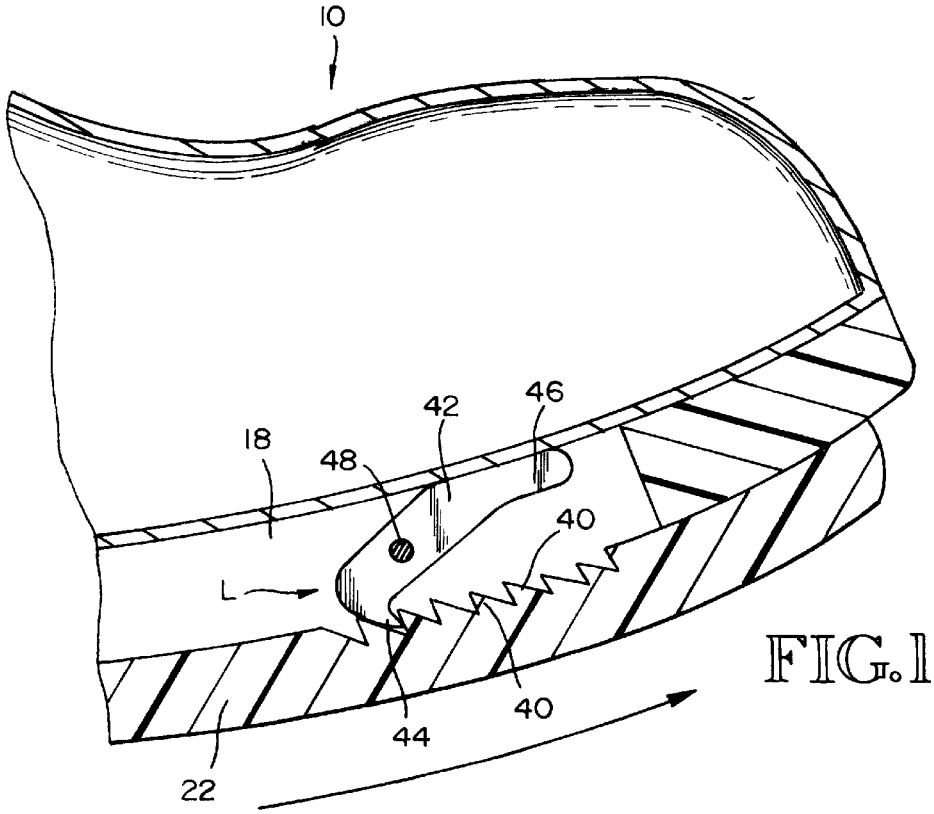
FIG. 14 is an enlarged scale fragmentary, diagrammatic view of the toe region of the shoe, showing the toe region in a raised position and showing a lock mechanism that is constructed to allow forward but not rearward movement of the sole relative to the rest of the shoe.
Figure 15:
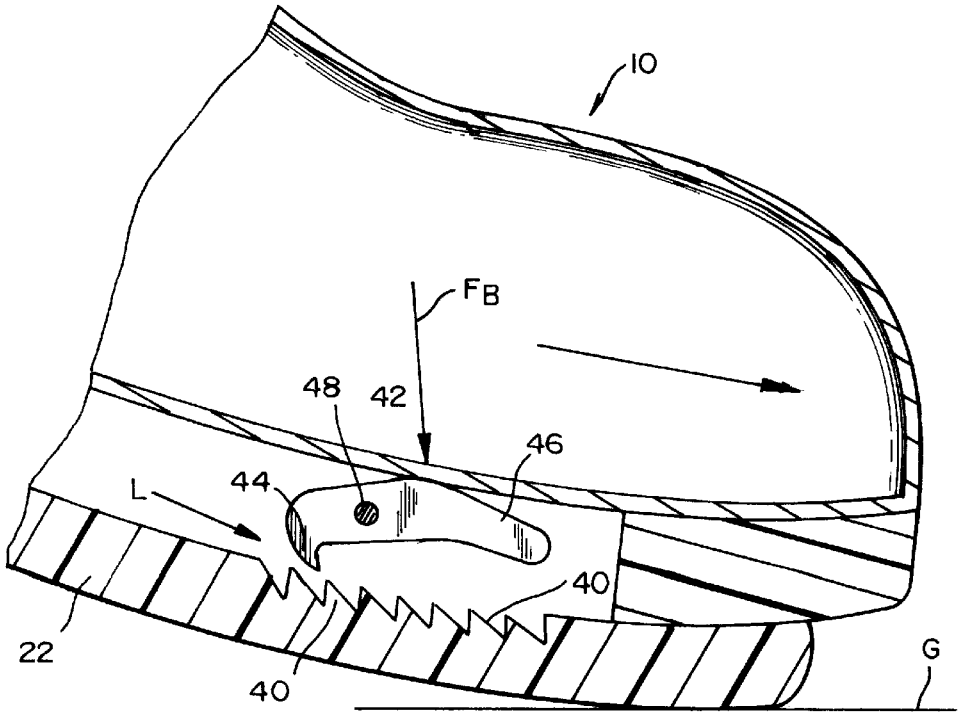
FIG. 15 is a view FIG. 14, but showing the toe region lowered and an unlocking force being applied to the locking mechanism, disengaging it from lock teeth on the lower sole and allowing the main portion of the shoe to move forwardly relative to the lower portion of the sole.

FIGS. 14 and 15 show the lower sole 22 provided with a row of lock teeth 40. The teeth 40 may be formed in a central portion of the lower sole 22. A lock lever 42 is mounted inside of the shoe 10, preferably in the base sole 18. Lock lever 42 includes a hook 44 at one end and an arm 46 at its opposite end. Lock lever 42 is supported by a pin or axle 48 for pivotal movement within a fore and aft vertical plane. FIG. 14 shows the toe region of the shoe 10 elevated to remove a downward force from the arm portion 46 of the lock lever 42. FIG. 14 also shows the hook 44 engaging one of the teeth 40. When the lock lever 42 and the teeth are in this position, the lower sole 22 can slide forwardly relative to the clip 44. However, lower sole 22 cannot slide rearwardly relative to the hook 44. Any tendency of the lower sole 22 to move rearwardly is stopped by engagement of the hook 44 and the tooth 40 immediately in front of hook 44. However, when the rear portion of the shoe 10 is raised, and the toe portion is lowered to place the lower sole 22 into contact with surface G, a force $F_b$ is applied substantially at the ball of the foot. This force $F_b$ is exerted on the arm 42 of lock lever 42, causing it to rotate in position about pin 48.

As lock lever 42 rotates, the hook 44 is moved away from the lock tooth 40. When hook 44 is out of engagement with the tooth 40, the shoe proper, above lower sole 22, is free to slide forwardly on the lower sole 22. As previously described, this moves the wearer's foot forwardly and results in an lengthening of the step.

The lower sole 22 may be connected to the part of the shoe above it in a number of ways. Sole 22 must be restrained against substantial movement sideways of the shoe 10 and it must be restrained against following downwardly away from the shoe 10. However, lower sole 22 must be free to move forwardly and rearwardly the distance a–c or b–d. Also, the lower sole 22 must be adapted for easy sliding movement on and relative to the structure above it. The base sole may include a downwardly directed varying material such as a self lubricated hard plastic material. Or, some type of anti-friction bearing may be incorporated into either a lower part of the base sole or an upper part of the lower sole 22.

Referring to FIG. 16 and 17, the lower sole 22 may be constructed to include a pair of longitudinally extending T-bars 60 and the base sole 18 may be provided with a pair of longitudinally extending insets 62, each of with includes a T-slot 64 sized to receive one of the T-bars 60, as shown by FIG. 16. T-bars 60 may include bearings 66 that make contact with top wall portions 68 of the insets 62. Referring to FIG. 16, when the wearer's weight is applied to the base sole 18, the lower sole 22 wants to move upwardly and the wall 68 wants to move downwardly. This moves the bearing 16 against the walls 68. The bearings 16 provides reduced friction where contact occurs.

As shown by FIG. 17, the lock teeth 40 may be formed in the lower sole 22 between the two T-bars 60. The lock levers 42 and the pivot pin 40 may be mounted between the two insets 62.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A shoe, comprising:

a main body portion including a base having a heel and a base sole, and an upper on the base;

a lower sole below said base sole, movable front to rear and back relative to said base sole; and a transducer in said heel and connected to the lower sole, for pushing the lower sole forwardly in response to heel pressure being imposed by the heel of the wearer on the heel of the shoe.

2. The shoe of claim 1, wherein the transducer includes an upwardly bowed leaf spring in the heel, having a forward end, wherein the transducer includes connecting structure interconnected between the forward end of the leaf spring and the lower sole, and wherein downward pressure on the leaf spring will flatten the leaf spring and move it and the connecting structure forwardly, to exert a forward pushing force on the lower sole.

3. The shoe of claim 2, comprising ratchet teeth on a portion of the lower sole and a locking lever incorporated within the base sole, said locking teeth and locking lever being adapted to permit a forward movement of the lower sole relative to the main body portion of the shoe, but locking the lower sole against rearward movement whenever there is no downward pressure acting on the locking lever, and wherein the locking lever is positioned to be moved from a locking position to an unlocking position by foot pressure acting downwardly onto the locking lever when the lower sole is on a supporting surface and the heel is elevated above the supporting surface.

4. The shoe of claim 3, further comprising a tension spring interconnected between the lower sole and a part of the main body portion of the shoe that is rearwardly of the lower sole portion, and arranged to extend when the lower sole is moved forwardly relative to the main body portion of the shoe, at to retract and exert a pulling force on the lower sole for pulling the lower sole rearwardly.

5. The shoe of claim 1, further comprising a tension spring interconnected between the lower sole and a part of the main body portion of the shoe rearwardly of the lower sole portion, and arranged to extend when the lower sole is moved forwardly relative to the main body portion of the shoe, at to retract and exert a pulling force on the lower sole for pulling the lower sole rearwardly.

6. The shoe of claim 2, further comprising a tension spring interconnected between the lower sole and a part of the main body portion of the shoe rearwardly of the lower sole portion, and arranged to extend when the lower sole is moved forwardly relative to the main body portion of the shoe, at to retract and exert a pulling force on the lower sole for pulling the lower sole rearwardly.

7. The shoe of claim 1, wherein the transducer includes a fluid chamber in the heel of the shoe having a deformable upper wall, and at least one tubular member extending forwardly from the fluid chamber towards the lower sole, and including an internal chamber, and a piston connected at a front end to the lower sole, and having a rear end portion that extends into the internal chamber of the tubular member, wherein a downward heel force on the upper wall of the fluid chamber will force fluid out from the fluid chamber and into the tubular chamber for exerting a force on the piston, for moving the piston and the lower sole forwardly.

8. The shoe of claim 7, comprising ratchet teeth on a portion of the lower sole and a locking lever incorporated within the base sole, said locking teeth and locking lever being adapted to permit a forward movement of the lower sole relative to the main body portion of the shoe, but locking the lower sole against rearward movement whenever there is no downward pressure acting on the locking lever, and wherein the locking lever is positioned to be moved from a locking position to an unlocking position by foot pressure acting downwardly onto the locking lever when the lower sole is on a supporting surface and the heel is elevated above the supporting surface.

9. The shoe of claim 7, further comprising a tension spring interconnected between the lower sole and a part of the main body portion of the shoe rearwardly of the lower sole portion, and arranged to extend when the lower sole is moved forwardly relative to the main body portion of the shoe, at to retract and exert a pulling force on the lower sole for pulling the lower sole rearwardly.

* * * * *